US007864120B2

(12) United States Patent
Dou et al.

(10) Patent No.: US 7,864,120 B2
(45) Date of Patent: Jan. 4, 2011

(54) HIGH ISOLATION ANTENNA DESIGN FOR REDUCING FREQUENCY COEXISTENCE INTERFERENCE

(75) Inventors: Weiping Dou, San Jose, CA (US); Avi Kopelman, Sunnyvale, CA (US)

(73) Assignee: Palm, Inc., Sunnyvale, CA (US)

( * ) Notice: Subject to any disclaimer, the term of this patent is extended or adjusted under 35 U.S.C. 154(b) by 617 days.

(21) Appl. No.: 11/756,455

(22) Filed: May 31, 2007

(65) Prior Publication Data

US 2008/0297419 A1 Dec. 4, 2008

(51) Int. Cl.
*H01Q 1/24* (2006.01)

(52) U.S. Cl. ..... 343/702

(58) Field of Classification Search ..... 343/702, 343/821, 729, 876, 893
See application file for complete search history.

(56) References Cited

U.S. PATENT DOCUMENTS 6,204,817 B1 * 3/2001 Edvardsson ..... 343/702
6,831,616 B1 12/2004 Vice
6,909,401 B2 6/2005 Rutfors
7,202,757 B2 4/2007 De Flaviis
7,352,332 B1 * 4/2008 Betts-LaCroix et al. ..... 343/729
7,511,673 B2 * 3/2009 Man et al. ..... 343/702
2004/0110481 A1 6/2004 Navsariwala
2005/0116869 A1 6/2005 Siegler et al.
2005/0176390 A1 8/2005 Navsariwala
2005/0200425 A1 9/2005 McKay
2006/0044195 A1 3/2006 Arkko
2006/0205343 A1 9/2006 Runyon et al.
2006/0270377 A1 * 11/2006 Bhatti et al. ..... 455/333
2007/0200773 A1 * 8/2007 Dou et al. ..... 343/702
2008/0055163 A1 * 3/2008 Man et al. ..... 343/702
2008/0076366 A1 * 3/2008 Rofougaran ..... 455/168.1
2008/0165065 A1 * 7/2008 Hill et al. ..... 343/702
2008/0198082 A1 * 8/2008 Soler Castany et al. ..... 343/770
2008/0261540 A1 * 10/2008 Rohani et al. ..... 455/77

* cited by examiner

*Primary Examiner*—Huedung Mancuso
(74) *Attorney, Agent, or Firm*—Kacvinsky Daisak PLLC

(57) ABSTRACT

Various embodiments are directed to high isolation antenna design for reducing frequency coexistence interference. In one embodiment, a computing device may comprise a printed circuit board including a first internal antenna and a second internal antenna operating in a common frequency band. At least one of the first internal antenna and the second internal antenna may comprise a balanced antenna coupled to an unbalancing element to suppress surface current on the printed circuit board and reduce frequency coexistence interference between the first internal antenna and the second internal antenna. Other embodiments are described and claimed.

21 Claims, 3 Drawing Sheets

HIGH ISOLATION ANTENNA DESIGN FOR REDUCING FREQUENCY COEXISTENCE INTERFERENCE

BACKGROUND

A mobile computing device may provide voice and data communications functionality, as well as computing and processing capabilities. For voice and data communications, a mobile computing device typically employs one or more radio transceivers and one or more antennas. Antenna design for a mobile computing device is an important consideration and is often limited by strict performance constraints.

In some cases, a mobile computing device may support multiple modes of communication using the same band of the radio frequency (RF) spectrum. For example, the mobile computing device may enable Bluetooth communication over a personal area network (PAN) as well as Wireless Fidelity (WiFi) communication over an Institute of Electrical and Electronics Engineers (IEEE) 802.11 wireless network using the 2.4 GHz range of the industrial, scientific and medical (ISM) frequency band. Although Bluetooth and 802.11 radio transceivers each utilize spread spectrum modulation techniques, if located on the same platform, strong surface current may lead to significant mutual coupling and coexistence interference when two antennas are working simultaneously.

For a mobile computing device with a small form factor (e.g., ID of 110 mm×60 mm or smaller), coexistence interference is especially problematic. Accordingly, there exists the need for improved antenna designs for reducing frequency coexistence interference.

DETAILED DESCRIPTION

Various embodiments are directed to internal antenna designs that may improve the performance of a mobile computing device by improving one or more of characteristics, such as a size, shape, form factor, power consumption, battery life, transceiver operations, signal quality, weight, and other characteristics of the mobile computing device. For example, various embodiments may reduce frequency coexistence interference and mutual coupling within a mobile computing device resulting in improved performance such as lower occurrences of transceiver blocking, less voice noise, and increased data rates. In various implementations, the described embodiments may provide flexibility for low-profile, small and compact device designs. Accordingly, a user may realize enhanced products and services.

While certain systems and techniques for reducing frequency coexistence interference may be described in the context of reducing antenna size for a mobile computing device, it can be appreciated that various chip components (e.g., inductors, capacitors) and/or circuitry (e.g., balun element, hybrid phase element) may be designed for implementation on a printed circuit board (PCB) or other device having a relatively larger size by modifying and/or choosing the length, width, and numbers of pitch.

Figure 1:
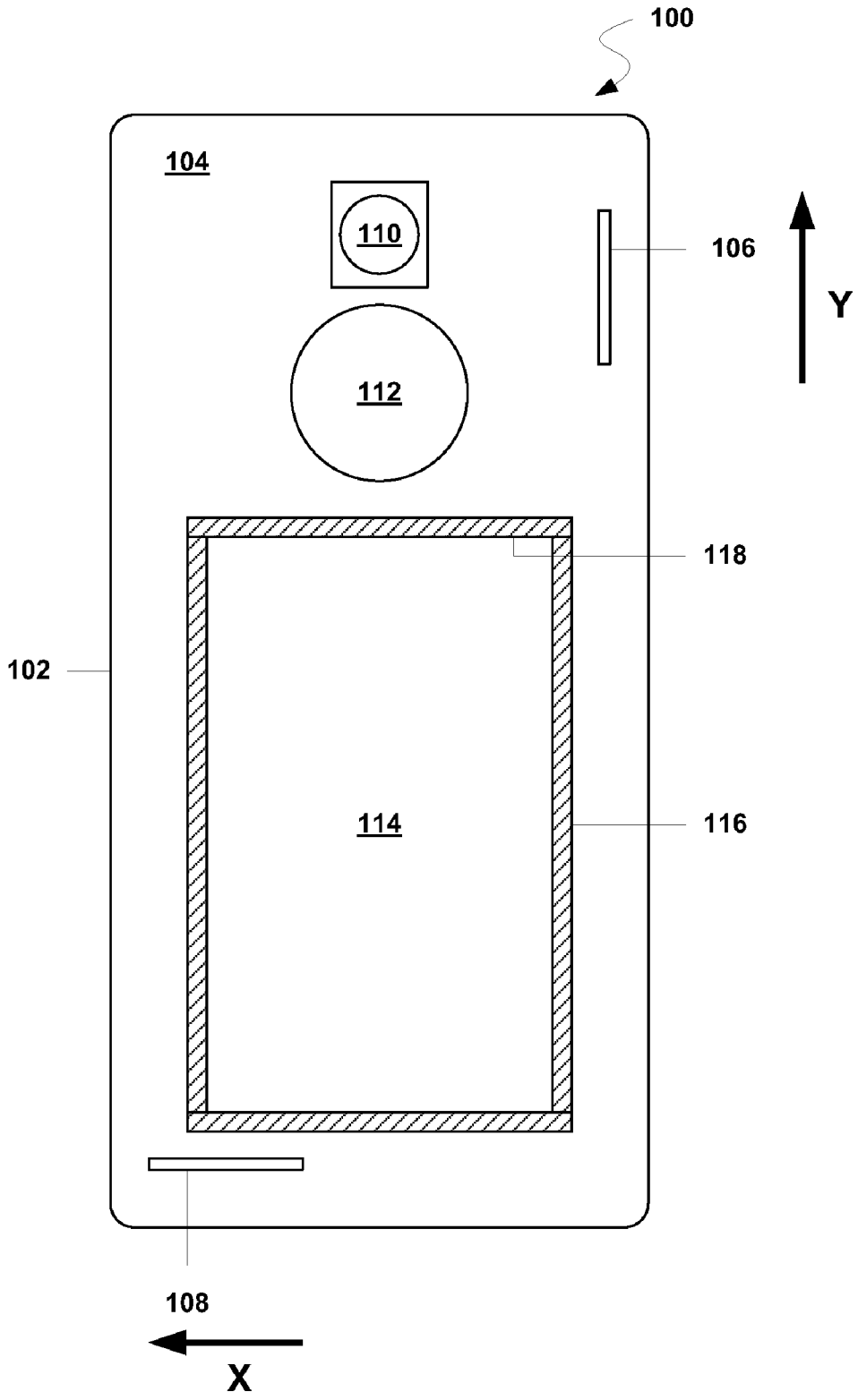
FIG. 1 illustrates one embodiment of a mobile computing device.

FIG. 1 illustrates one embodiment of a mobile computing device 100. Mobile computing device 100 may comprise or be implemented as a combination handheld computer and mobile telephone, sometimes referred to as a smart phone. Examples of smart phones include, for example, Palm® products such as Palm® Treo™ smart phones. Although some embodiments may be described with the mobile computing device 100 implemented as a smart phone by way of example, it may be appreciated that the embodiments are not limited in this context. For example, the mobile computing device 100 may comprise, or be implemented as, any type of wireless device, mobile station, or portable computing device with a self-contained power source (e.g., battery) such as a laptop computer, handheld device, personal digital assistant (PDA), mobile telephone, combination mobile telephone/PDA, mobile unit, subscriber station, user terminal, portable computing device, wearable computing device, game device, messaging device, media player, pager, data communication device, or any other suitable computing or processing system in accordance with the described embodiments.

Mobile computing device 100 may provide voice communications functionality in accordance with various cellular telephone systems. Examples of cellular telephone systems may include Code Division Multiple Access CDMA systems, Global System for Mobile Communications (GSM) systems, North American Digital Cellular (NADC) systems, Time Division Multiple Access (TDMA) systems, Extended-TDMA (E-TDMA) systems, Narrowband Advanced Mobile Phone Service (NAMPS) systems, third generation (3G) systems such as Wide-band CDMA (WCDMA), CDMA-2000, Universal Mobile Telephone System (UMTS) systems, and others.

In addition to voice communications functionality, mobile computing device 100 may be arranged to provide wireless wide area network (WWAN) data communications functionality in accordance with various cellular telephone systems. Examples of cellular telephone systems offering WWAN data communications services may include EV-DO systems, Evolution For Data and Voice (EV-DV) systems, CDMA/1xRTT systems, GSM with General Packet Radio Service (GPRS) systems (GSM/GPRS), Enhanced Data Rates for Global Evolution (EDGE) systems, High Speed Downlink Packet Access (HSDPA) systems, High Speed Uplink Packet Access (HSUPA), and others.

Mobile computing device 100 may be arranged to provide data communications functionality in accordance with various types of wireless local area network (WLAN) systems. Examples of suitable WLAN systems offering data communication services may include the Institute of Electrical and Electronics Engineers (IEEE) 802.xx series of protocols, such as the IEEE 802.11a/b/g/n series of standard protocols and variants (also referred to as "WiFi"), the IEEE 802.16 series of standard protocols and variants (also referred to as "WiMAX"), the IEEE 802.20 series of standard protocols and variants, and others.

Mobile computing device 100 may be arranged to perform data communications in accordance with various types of shorter range wireless systems, such as a wireless PAN system. One example of a suitable wireless PAN system offering data communications services may include a Bluetooth system operating in accordance with the Bluetooth Special Interest Group (SIG) series of protocols, including Bluetooth Specification versions v1.0, v1.1, v1.2, v2.0, v2.0 with Enhanced Data Rate (EDR), as well as one or more Bluetooth Profiles, and so forth. Other examples may include systems using infrared techniques or near-field communication techniques and protocols, such as electromagnetic induction (EMI) techniques. An example of EMI techniques may include passive or active radio-frequency identification (RFID) protocols and devices.

Mobile computing device 100 may operate in one or more frequency bands or sub-bands such as the 2.4 GHz range of the ISM frequency band for WiFi and Bluetooth communications, one or more of the 850 MHz, 900 MHZ, 1800 MHz, and 1900 MHz frequency bands for GSM, CDMA, TDMA, NAMPS, cellular, and/or PCS communications, the 2100 MHz frequency band for CDMA2000/EV-DO and/or WCDMA/JMTS communications, the 1575 MHz frequency band for Global Positioning System (GPS) operations, and other frequency bands. This may be desirable since mobile computing device 100 may be compatible with multiple wireless data, multimedia and cellular telephone systems.

In some embodiments, mobile computing device 100 may be implemented as a multi-band wireless device supporting operation in multiple frequency bands. In addition, mobile computing device 100 may implement various spatial diversity techniques to improve communication of wireless signals across one or more frequency bands of wireless shared media such as EV-DO diversity at both the 850 MHz cellular band and the 1900 MHz PCS band.

As shown in FIG. 1, Mobile computing device 100 may comprise a housing 102. Housing 102 may include one or more materials such as plastic, metal, ceramic, glass, carbon fiber, various polymers, and so forth, suitable for enclosing and protecting the internal components of mobile computing device 100. Housing 102 may be used to encapsulate various internal components for mobile computing device 100 such as a removable and rechargeable battery, processors, memory, transceivers, printed circuit boards, antennas, and so forth. In various embodiments, housing 102 may have a shape, size and/or form factor capable of being held with an average human hand, such as a handheld computer, cellular telephone, PDA, combination PDA/cellular telephone, smart phone, and so forth.

Mobile computing device 100 may comprise a printed circuit board (PCB) 104. PCB 104 may be implemented using materials such as FR4, Rogers R04003, and/or Roger RT/Duroid, for example, and may include one or more conductive traces, via structures, and/or laminates. PCB 104 also may include a finish such as Gold, Nickel, Tin, or Lead. In various implementations, PCB 104 may be fabricated using processes such as etching, bonding, drilling, and plating.

Mobile computing device 100 may have an internal antenna architecture comprising a first internal antenna 106 and a second internal antenna 108 disposed on the PCB 104. In various embodiments, first internal antenna 106 and/or second internal antenna 108 each may comprise a single antenna or may be part of an array of antennas, such as a quad band antenna array. First internal antenna 106 and second internal antenna 108 may remain in a fixed position internal to the housing 102 in order to reduce the size and form factor of mobile computing device 100. Although only first internal antenna 106 and second internal antenna 108 are shown for purposes of illustration, it can be appreciated that mobile computing device 100 may comprise other internal and/or external antennas in accordance with the described embodiments. For example, multiple antennas in the form an antenna array may be employed when implementing spatial diversity techniques (e.g., beamforming) and/or high-throughput Multiple-Input-Multiple-Output (MIMO) systems (e.g., 802.11n and 802.16e systems).

In some embodiments, first internal antenna 106 and/or second internal antenna 108 may comprise a flexible material or substrate. A flexible material may include any pliant material that is capable of being bent or flexed such as a flexible printed circuit (FPC). Other flexible materials may be used, however, such as a wire material, helical material, Teflon material, RF4 material, Mylar material, dielectric substrate, a soft plastic material, and other flexible materials.

In some embodiments, first internal antenna 106 and/or second internal antenna 108 may comprise a rigid material rather than a flexible material. A rigid material may include any material that is deficient in or devoid of flexibility. Examples of rigid materials may include metal materials, plastic materials, ceramic materials, and so forth. In one embodiment, for example, first internal antenna 106 and/or second internal antenna 108 may be formed using a flat stamped metal having suitable characteristics according to the design and performance constraints for mobile computing device 100.

First internal antenna 106 and/or second internal antenna 108 may be etched into PCB 104, mounted to PCB 104, or integrated with the midframe or housing 102 of mobile computing device 100. In some cases, first internal antenna 106 and/or second internal antenna 108 may comprise multiple layers and/or multiple traces. The number of layers and length of each layer may vary for a particular implementation. The antenna traces may have any suitable pattern or geometry tuned for various operating frequencies.

First internal antenna 106 and second internal antenna 108 may be arranged to transmit and/or receive electrical energy in accordance with a given set of performance or design constraints as desired for a particular implementation. For example, first internal antenna 106 and second internal antenna 108 may be configured for both transmission and reception. Such an arrangement could be used in WiFi or WiMax, for example, to improve data rate and voice service as well as to reduce multi-path interference, improve coverage, and increase system capacity. In various embodiments, first internal antenna 106 and second internal antenna 108 may operate at the same time for transmitting, receiving, or both.

During transmission, an antenna (e.g., first internal antenna 106 and/or second internal antenna 108) may accept energy from a transmission line and radiate energy into space via a wireless shared media. During reception, an antenna may gather energy from an incident wave received over the wireless shared media, and provide energy to a corresponding transmission line. In various embodiments, an antenna may operate in accordance with a desired Voltage Standing Wave Ratio (VSWR) value related to the impedance match of an antenna feed point and a conducting transmission line. To radiate RF energy with minimum loss and/or to pass received RF energy to a receiver with minimum loss, antenna impedance may need to be matched to the impedance of the conducting transmission line or feed point of PCB 104.

First internal antenna 106 and the second internal antenna 108 may be tuned for operating at one or more frequency bands. In various embodiments, first internal antenna 106 and second internal antenna 108 may be arranged to operate using the same frequency band such as the 2.4 GHz range of the ISM frequency band. For example, first internal antenna 106 may allow WiFi communication over an IEEE 802.11 wireless network, and second internal antenna 108 may allow Bluetooth communication over a PAN. Although some embodiments may be described in the context of the 2.6 GHz range of the ISM frequency band for purposes of illustration, it can be appreciated that the systems and techniques for reducing frequency coexistence interference described herein may be employed for other frequency bands in accordance with the described embodiments.

First internal antenna 106 and second internal antenna 108 may have different polarities to reduce frequency coexistence interference. In various embodiments, first internal antenna 106 and second internal antenna 108 may have opposing orthogonal polarizations. For example, first internal antenna 106 may be vertically polarized along axis (Y), and second internal antenna 108 may be horizontally polarized along axis (X).

In various embodiments, the spatial separation between first internal antenna 106 and second internal antenna 108 may be increased and/or maximized to reduce frequency coexistence interference. For example, first internal antenna 106 and second internal antenna 108 may be positioned substantially in opposite corners of mobile computing device 100 or PCB 104. As shown in FIG. 1, first internal antenna 106 may be structured and arranged in close proximity to various components of mobile computing device 100 such as a speaker 210, a camera 212, and/or other components. While mobile computing device 100 illustrates an exemplary embodiment of an internal antenna design, it can be appreciated that the precise placement or location of first internal antenna 106 and second internal antenna 108 on PCB 104 may be determined in accordance with various performance and design constraints.

As shown, first internal antenna 106 and second internal antenna 108 may be separated by a battery 114 within a battery compartment 116 of mobile computing device 100. In various embodiments, the battery compartment 116 may comprise one or more high isolation vertical shield walls 118 to reduce frequency coexistence interference. When implemented in the battery area or other common area between first internal antenna 106 and second internal antenna 108, shield walls 118 may isolate first internal antenna 106 and second internal antenna 108 and suppress the propagation of electromagnetic (EM) waves to achieve higher isolation.

Both first internal antenna 106 and second internal antenna 108 may radiate in all the three-dimensional directions. In a common area, such as the battery area, the E-field and H-field elements of first internal antenna 106 and second internal antenna 108 may interfere with each other. Accordingly, shield walls 118 may suppress such interference so that radio performance is not degraded even if the distance between first antenna 106 and second antenna 108 is relatively close with respect to the operating wavelength, for example, 110 mm and 2.4 GHz. This additional isolation may be important for applications and/or systems which have strict interference requirements as well as for devices with smaller platforms.

The shield walls 118 may be implemented by one or more walls comprising a conductive shielding material such as one or more metals, metallic ink, or other suitable material. In some implementations, shield walls 118 may be shorted to PCB 104 to achieve better shielding performance. Shield walls 118 also may comprise connected walls by using one or more metal pieces to cover the top side or/and bottom side of battery 114. Such metal cover piece(s) may extend beyond the batter compartment 116 and closer to first internal antenna 106 and/or second internal antenna 108. In addition, isolation may be improved by attaching absorbent material on the shield walls 118 and/or cover pieces. Shield walls 118 and/or metal cover pieces also may be integrated into the midframe of the mobile computing device 100 to enhance its mechanical strength.

In various embodiments, first internal antenna 106 and second internal antenna 108 each may comprise a balanced antenna to reduce frequency coexistence interference. In such embodiments, first internal antenna 106 and second internal antenna 108 may be implemented by a balanced dipole antenna or other suitable balanced antenna. When implemented as balanced antennas, first internal antenna 106 and second internal antenna 108 may induce weaker surface current on the PCB 104 and provide lower mutual coupling as compared to unbalances antennas.

For wireless devices having small form factors, it may be disadvantageous to employ an unbalanced antenna such as a planar inverted-F antenna (PIFA) or a monopole antenna in an internal antenna design for 2.4 GHz operation. Such unbalanced antennas would utilize the PCB 104 as a counter-arm resulting in strong surface current on the PCB 104 leading to significant mutual coupling and frequency coexistence interference when first internal antenna 106 and second internal antenna 108 are working simultaneously in the same frequency band.

Figure 2A:
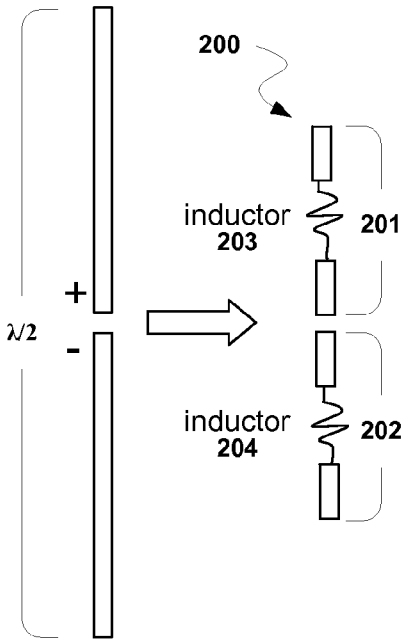
FIG. 2A illustrates one embodiment of a balanced antenna.
Figure 2B:
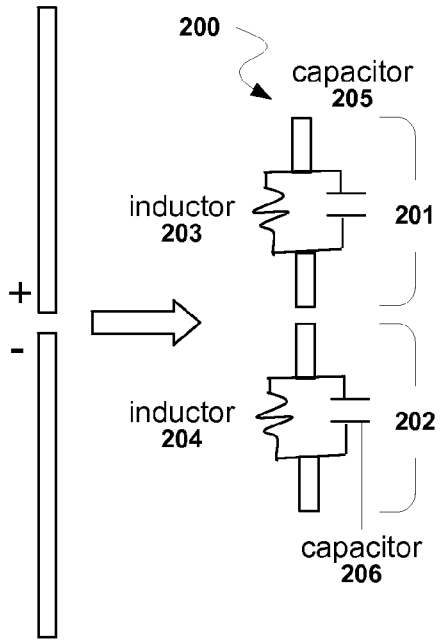
FIG. 2B illustrates one embodiment of a balanced antenna.

FIG. 2A and FIG. 2B illustrate various embodiments of a balanced antenna 200. Balanced antenna 200 may be implemented as the first internal antenna 106 and/or second internal antenna 108 of mobile computing device 100. The embodiments are not limited in this context.

Balanced antenna 200 may be implemented as a dipole antenna comprising a first antenna arm 201 and a second antenna arm 202. First antenna arm 201 and second antenna arm 202 may be implemented by antenna traces and/or branch lines and may comprise various chip components (e.g., resistors, capacitors, inductors) and/or circuitry to reduce the size of balanced antenna 200.

As shown, first antenna arm 201 and second antenna arm 202 each may comprise one or more chip components and/or circuitry in order to significantly reduce the size of balanced antenna 200. In FIG. 2A, for example, first antenna arm 201 may comprise a series inductor 203, and second antenna arm 202 may comprise a series inductor 204. In FIG. 2B, first antenna arm 201 may comprise inductor 203 in parallel with a capacitor 205, and second antenna arm 202 may comprise inductor 204 in parallel with a capacitor 206. While FIGS. 2A and 2B illustrate exemplary embodiments of balanced antenna 200, it can be appreciated that various other configurations, chip components and/or circuitry may be implemented in accordance with the described embodiments.

By inserting one or more chip component and/or circuitry into first antenna arm 201 and second antenna arm 202, the size of balanced antenna 200 may be significantly reduced from a typical length which may be approximately one half wavelength ($\lambda/2$) long or about 62.5 mm for 2.4 GHz. Accordingly, balanced antenna 200 may be suitable for use as first internal antenna 106 and second internal antenna 108 in mobile computing device 100 to allow greater spatial separation between first internal antenna 106 and second internal antenna 108 and to reduce frequency coexistence interference.

Figure 3:
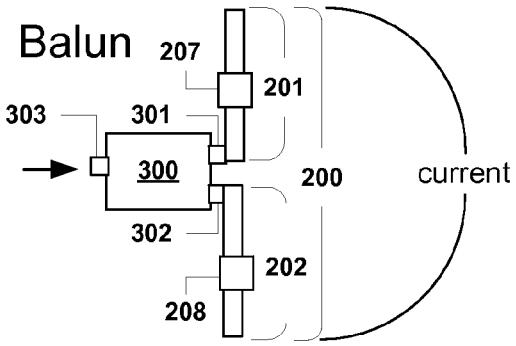
FIG. 3 illustrates one embodiment of a balun element coupled to a balanced antenna.

FIG. 3 illustrates one embodiment of a balun (balanced/unbalanced) element 300 coupled to balanced antenna 200. As described above, balanced antenna 200 may be implemented as the first internal antenna 106 and/or second internal antenna 108 of mobile computing device 100. As shown, balanced antenna 200 may comprise first antenna arm 201 including a first load 207 and second antenna arm 202 including a second load 208. First load 207 and second load 208 each may comprise one or more chip components and/or circuitry in order to significantly reduce the size of balanced antenna 200. For example, first load 207 and second load 208 may be implemented as described in FIGS. 2A and 2B. The embodiments are not limited in this context.

Balun element 300 may comprise various devices and/or circuitry that, when coupled to balanced antenna 200, may reduce the overall size of balanced antenna 200. Balun element 300 may be implemented, for example, by an on-chip balun, discrete balun, ceramic balun, micro-strip balun, or other suitable device or circuitry in accordance with the described embodiments. In various embodiments, balun element 300 may support bandwidths which are relatively narrow (e.g., 3%) but suitable for Bluetooth and 802.11b/g coexistence.

Balun element 300 may comprise a first balanced port 301 coupled to first antenna arm 201 and a second balanced port 302 coupled to second antenna arm 202. Balun element 300 may comprise an unbalanced port 303 to effect balanced/unbalanced transitions. Unbalanced port 303 may comprise an input port or an output port depending on a particular implementation. For example, balun element 300 may comprise a bidirectional device to transition from balanced I/Os to unbalanced I/Os and vice versa.

In various embodiments, balun element 300 may be arranged to transition and/or transform balanced antenna 200 from balanced to unbalanced. In such embodiments, balun element 300 may suppress PCB surface current to improve isolation of balanced antenna 200 and reduce frequency coexistence interference. For example, balun element 300 may keep first antenna arm 201 and second antenna arm 202 balanced so that first antenna arm 201 and second antenna arm 202 have the same current distribution. When coupled to first internal antenna 106 and/or second internal antenna 108 of FIG. 1, for example, balun element 300 may prevent current from leaking to PCB 104 to improve isolation and reduce frequency coexistence interference.

In some cases, a ground plane may be required underneath first internal antenna 106 and second internal antenna 108. When sharing the ground plane, first internal antenna 106 and second internal antenna 108 inherently are coupled to each other which may compromise the isolation between first internal antenna 106 and second internal antenna 108. To improve isolation, first internal antenna 106 and/or second internal antenna 108 may be drawn through a corresponding balun 300. By drawing one or both internal antennas (e.g., first internal antenna 106, second internal antenna 108) through a corresponding balun element 300, the antennas may be disconnected from the ground plane and/or each other to improve isolation between the antennas and reduced frequency coexistence interference.

Figure 4:
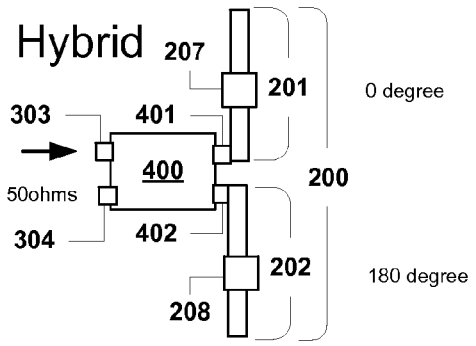
FIG. 4 illustrates one embodiment of a phase hybrid element coupled to a balanced antenna

FIG. 4 illustrates one embodiment of a phase hybrid element 400 coupled to a balanced antenna 200. As described above, balanced antenna 200 may be implemented as the first internal antenna 106 and/or second internal antenna 108 of mobile computing device 100. As shown, balanced antenna 200 may comprise first antenna arm 201 including a first load 207 and second antenna arm 202 including a second load 208. First load 207 and second load 208 each may comprise one or more chip components and/or circuitry in order to significantly reduce the size of balanced antenna 200. For example, first load 207 and second load 208 may be implemented as described in FIGS. 2A and 2B. The embodiments are not limited in this context.

Phase hybrid element 400 may comprise various devices and/or circuitry that, when coupled to balanced antenna 200, may reduce the overall size of balanced antenna 200. In various embodiments, phase hybrid element 400 may be arranged to perform functions similar to balun element 300 but for much broader bandwidth. For example, the bandwidth could be 3:1 to 10:1.

Phase hybrid element 400 may comprise a 180 degree phase hybrid device arranged to equally divide power between a first output port 401 and a second output port 402 with either a 0 or 180 degree phase. First output port 401 may be coupled to first antenna arm 201 to implement a 0 degree phase, and second output port 402 may be coupled to second antenna arm 202 to implement a 180 degree phase. Phase hybrid element 400 may be arranged so that currents in first antenna arm 201 and second antenna arm 202 are of equal magnitude but out of phase. As shown, phase hybrid element 400 also may comprise an input port 403 and an I/O port 404 designed with defined impedance (e.g., 50 ohm impedance).

In various implementations, phase hybrid element 400 may suppress PCB surface current to improve isolation of balanced antenna 200 and reduce frequency coexistence interference. When coupled to first internal antenna 106 and/or second internal antenna 108 of FIG. 1, for example, phase hybrid element 400 may prevent current from leaking to PCB 104 to improve isolation and reduce frequency coexistence interference. By drawing one or both internal antennas (e.g., first internal antenna 106, second internal antenna 108) through a corresponding phase hybrid (e.g., phase hybrid element 400), the antennas may be disconnected from a shared ground plane and/or each other to improve isolation between the antennas and reduced frequency coexistence interference.

Figure 5:
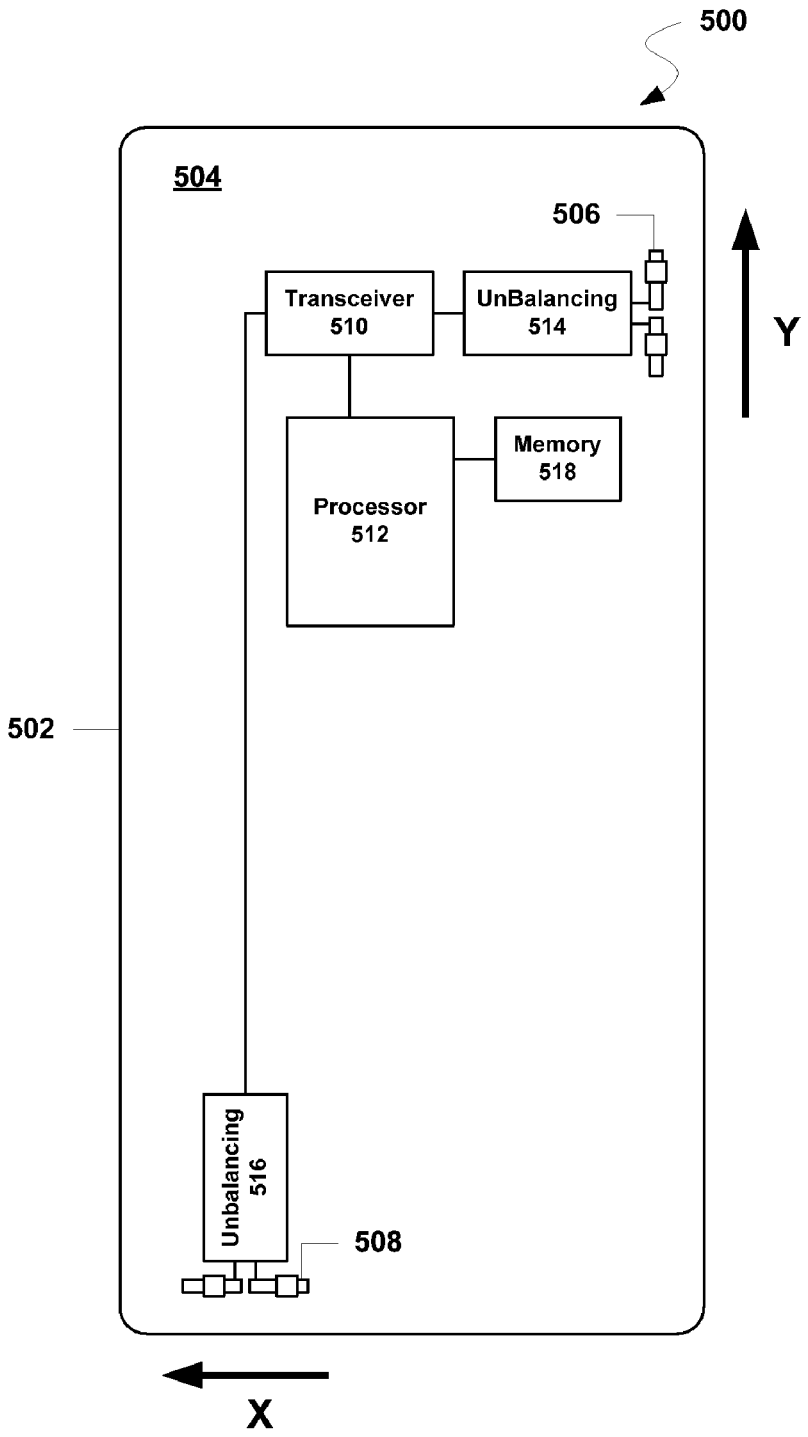
FIG. 5 illustrates one embodiment of a mobile computing device.

FIG. 5 illustrates one embodiment of a mobile computing device 500 having an internal antenna architecture. Mobile computing device 500 may comprise a housing 502 and a PCB 504 including a first internal antenna 506 and a second internal antenna 508. In various embodiments, mobile computing device 500 may be similar in some structural and operational aspects as mobile computing device 100 and implemented as described above with reference to FIGS. 1-4. For example, first internal antenna 506 and/or second internal antenna 508 may comprise a balanced antenna (e.g., balanced antenna 200) implemented as described with reference to FIGS. 2A and 2B.

First internal antenna 506 and second internal antenna 508 may be coupled to a transceiver module 510 operatively associated with a processor module 512. First internal antenna 506 may be coupled to transceiver module 510 via first unbalancing element 514, and second internal antenna 508 may be connected to a transceiver module 510 via second unbalancing element 516. In various embodiments, first unbalancing element 514 and/or second unbalancing 516 element may be implemented as a balun (e.g., balun element 300) or a phase hybrid (e.g., phase hybrid element 400) as described with reference to FIG. 3 and FIG. 4.

Transceiver module 510 may comprise one or more transceivers arranged to communicate using different types of protocols, communication ranges, operating power requirements, RF sub-bands, information types (e.g., voice or data), use scenarios, applications, and so forth. In various embodiments, transceiver module 510 also may comprise one or more transceivers arranged to perform data communications in accordance with one or more wireless communications protocols such as WWAN protocols (e.g., GSM/GPRS protocols, CDMA/1xRTT protocols, EDGE protocols, EV-DO protocols, EV-DV protocols, HSDPA protocols, etc.), WLAN protocols (e.g., IEEE 802.11a/b/g/n, IEEE 802.16, IEEE 802.20, etc.), PAN protocols, Infrared protocols, Bluetooth protocols, EMI protocols including passive or active RFID protocols, and so forth. Transceiver module 510 also may comprise one or more transceivers arranged to support voice communication for a cellular telephone system such as a GSM, UMTS, and/or CDMA system. In some embodiments, transceiver module 304 may comprise a Global Positioning System (GPS) transceiver to support position determination and/or location-based services.

Processor module 512 may comprise one or more processors for performing operations in accordance with the described embodiments. Examples of a processor may include, without limitation, a central processing unit (CPU), general purpose processor, dedicated processor, chip multiprocessor (CMP), communications processor, radio processor, baseband processor, network processor, media processor, digital signal processor (DSP), media access control (MAC) processor, input/output (I/O) processor, embedded processor, co-processor, microprocessor, controller, microcontroller, application specific integrated circuit (ASIC), field programmable gate array (FPGA), programmable logic device (PLD), or other suitable processing device in accordance with the described embodiments.

In various embodiments, processor module 512 may comprise a radio processor implemented as a communications processor using any suitable processor or logic device, such as a modem processor or baseband processor. The radio processor may be arranged to communicate voice information and/or data information over one or more assigned frequency bands of a wireless communication channel. The radio processor may be arranged to perform analog and/or digital baseband operations such as digital-to-analog conversion (DAC), analog-to-digital conversion (ADC), modulation, demodulation, encoding, decoding, encryption, decryption, and so forth. The radio processor may comprise both analog and digital baseband sections. The analog baseband section may include I & Q filters, analog-to-digital converters, digital-to-analog converters, audio circuits, and other circuits. The digital baseband section may include one or more encoders, decoders, equalizers/demodulators, Gaussian Minimum Shift Keying (GSMK) modulators, GPRS ciphers, transceiver controls, automatic frequency control (AFC), automatic gain control (AGC), power amplifier (PA) ramp control, and other circuits.

In some embodiments, processor module 512 may implement a dual processor architecture including a radio processor and a host processor. In such embodiments, the host processor may be implemented as a host CPU using any suitable processor or logic device, such as a as a general purpose processor. The host processor and the radio processor may communicate with each other using interfaces such as one or more universal serial bus (USB) interfaces, micro-USB interfaces, universal asynchronous receiver-transmitter (UART) interfaces, general purpose input/output (GPIO) interfaces, control/status lines, control/data lines, audio lines, and so forth. Although some embodiments may be described as comprising a dual processor architecture for purposes of illustration, it is worthy to note that processor module 512 may comprise any suitable processor architecture and/or any suitable number of processors in accordance with the described embodiments.

The host processor may be responsible for executing various software programs such as system programs and application programs to provide computing and processing operations for mobile computing device 500. System programs generally may assist in the running of mobile computing device 500 and may be directly responsible for controlling, integrating, and managing the individual hardware components of the computer system. The system programs may comprise at least one operating system (OS) implemented, for example, as one or more of a Palm OS®, Palm OS® Cobalt, Microsoft® Windows OS, Microsoft Windows® CE OS, Microsoft Pocket PC OS, Microsoft Mobile OS, Symbian OS™, Embedix OS, Linux OS, Binary Run-time Environment for Wireless (BREW) OS, JavaOS, a Wireless Application Protocol (WAP) OS, or other suitable OS in accordance with the described embodiments. Mobile computing device 500 may comprise other system programs such as device drivers, programming tools, utility programs, software libraries, application programming interfaces (APIs), and so forth.

Application programs generally may allow a user to accomplish one or more specific tasks. In various implementations, application programs may provide one or more graphical user interfaces (GUIs) to communicate information between mobile computing device 500 and a user. In some embodiments, application programs may comprise upper layer programs running on top of the OS that operate in conjunction with the functions and protocols of lower layers including, for example, a transport layer such as a Transmission Control Protocol (TCP) layer, a network layer such as an Internet Protocol (IP) layer, and a link layer such as a Point-to-Point (PPP) layer used to translate and format data for communication.

Examples of application programs may include, without limitation, messaging applications, web browsing applications, personal information management (PIM) applications (e.g., contacts, calendar, scheduling, tasks), word processing applications, spreadsheet applications, database applications, media applications (e.g., video player, audio player, multimedia player, television, digital camera, video camera, media management), gaming applications, GPS applications, LBS applications, and other types of applications in accordance with the described embodiments. The messaging applications may comprise, for example, a telephone application such as a cellular telephone application, a Voice over Internet Protocol (VOIP) application, a Push-to-Talk (PTT) application, and so forth. The messaging applications may further comprise a voicemail application, a facsimile application, a video teleconferencing application, an instant messaging (IM) application, an e-mail application, a Short Message Service (SMS) application, a Multimedia Messaging (MMS) application, and so forth.

The processor module 512 may be coupled to a memory 518. Memory 518 may comprise various types of computer-readable media capable of storing data such as volatile or non-volatile memory, removable or non-removable memory, erasable or non-erasable memory, writeable or re-writeable memory, and so forth. Examples of computer-readable storage media may include, without limitation, random-access memory (RAM), dynamic RAM (DRAM), Double-Data-Rate DRAM (DDRAM), synchronous DRAM (SDRAM), static RAM (SRAM), read-only memory (ROM), programmable ROM (PROM), erasable programmable ROM (EPROM), electrically erasable programmable ROM (EEPROM), flash memory (e.g., NOR or NAND flash memory), content addressable memory (CAM), polymer memory (e.g., ferroelectric polymer memory), phase-change memory, ovonic memory, ferroelectric memory, silicon-oxide-nitride-oxide-silicon (SONOS) memory, magnetic or optical cards, or any other suitable type of computer-readable media in accordance with the described embodiments. It can be appreciated that memory 518 may be separate from a processor or may be included on the same integrated circuit as a processor. In some cases, some portion or the entire memory 518 may be disposed on an integrated circuit or other medium (e.g., hard disk drive, memory card) external to a processor and accessible via a memory bus.

Numerous specific details have been set forth to provide a thorough understanding of the embodiments. It will be understood, however, that the embodiments may be practiced without these specific details. In other instances, well-known operations, components and circuits have not been described in detail so as not to obscure the embodiments. It can be appreciated that the specific structural and functional details are representative and do not necessarily limit the scope of the embodiments.

Various embodiments may comprise one or more elements. An element may comprise any structure arranged to perform certain operations. Each element may be implemented as hardware, software, or any combination thereof, as desired for a given set of design and/or performance constraints. Although an embodiment may be described with a limited number of elements in a certain topology by way of example, the embodiment may include more or less elements in alternate topologies as desired for a given implementation.

It is worthy to note that some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other. With respect to software elements, for example, the term "coupled" may refer to interfaces, message interfaces, API, exchanging messages, and so forth.

Various embodiments may comprise one or more functional components or modules for performing various operations. It can be appreciated that such components or modules may be implemented by one or more hardware components, software components, and/or combination thereof. The functional components and/or modules may be implemented, for example, by logic (e.g., instructions, data, and/or code) to be executed by a logic device (e.g., processor). Such logic may be stored internally or externally to a logic device on one or more types of computer-readable storage media.

It also is to be appreciated that the described embodiments illustrate exemplary implementations, and that the functional components and/or modules may be implemented in various other ways which are consistent with the described embodiments. Furthermore, the operations performed by such components or modules may be combined and/or separated for a given implementation and may be performed by a greater number or fewer number of components or modules.

Unless specifically stated otherwise, it may be appreciated that terms such as "processing," "computing," "calculating," "determining," or the like, refer to the action and/or processes of a computer or computing system, or similar electronic computing device.

It also is worthy to note that any reference to "one embodiment" or "an embodiment" means that a particular feature, structure, or characteristic described in connection with the embodiment is included in at least one embodiment. The appearances of the phrase "in one embodiment" in the specification are not necessarily all referring to the same embodiment.

While certain features of the embodiments have been illustrated as described above, many modifications, substitutions, changes and equivalents will now occur to those skilled in the art. It is therefore to be understood that the appended claims are intended to cover all such modifications and changes as fall within the true spirit of the embodiments.

The invention claimed is:

1. A computing device, comprising:

a printed circuit board including a first internal antenna and a second internal antenna to operate in a common frequency band, at least one of the first internal antenna and the second internal antenna comprising a balanced antenna coupled to an unbalancing element to suppress surface current on the printed circuit board and reduce frequency coexistence interference between the first internal antenna and the second internal antenna; and wherein the first internal antenna and the second internal antenna separated by a battery compartment.

2. The computing device of claim 1, the first internal antenna and second internal antenna positioned in substantially opposite corners of the printed circuit board.

3. The computing device of claim 1, the battery compartment comprising one or more shield walls to reduce frequency coexistence interference.

4. The computing device of claim 1, the first internal antenna and second internal antenna having opposing orthogonal polarizations.

5. The computing device of claim 1, at least one of the first internal antenna and the second internal antenna comprising a first antenna arm including a first load and a second antenna arm including a second load.

6. The computing device of claim 5, the first load and second load each comprising an inductor.

7. The computing device of claim 5, the first load and second load each comprising a capacitor.

8. The computing device of claim 1, the unbalancing element comprising a balun element.

9. The computing device of claim 8, the balun element comprising a first balanced port coupled to a first antenna arm and a second balanced port coupled to a second antenna arm.

10. The computing device of claim 9, the first antenna arm including a first load and the second antenna arm including a second load.

11. The computing device of claim 1, the unbalancing element comprising a phase hybrid element.

12. The computing device of claim 11, the phase hybrid element comprising a 0 degree phase output port coupled to a first antenna arm and a 180 degree phase output port coupled to a second antenna arm.

13. The computing device of claim 12, the first antenna arm including a first load and the second antenna arm including a second load.

14. The computing device of claim 1, further comprising a ground plane shared by the first internal antenna and the second internal antenna.

15. The computing device of claim 12, the unbalancing element to disconnect at least one of the first internal antenna and the second internal antenna from the ground plane.

16. A mobile computing device, comprising:

a housing enclosing a printed circuit board including a first internal antenna to allow WiFi communication and a second internal antenna to allow Bluetooth communication, at least one of the first internal antenna and the second internal antenna comprising a balanced antenna coupled to a balun element to suppress surface current on the printed circuit board and reduce frequency coexistence interference between the first internal antenna and the second internal antenna; and wherein the first internal antenna and the second internal antenna separated by a battery compartment.

17. The mobile computing device of claim 16, further comprising the battery compartment including one or more shield walls to reduce frequency coexistence interference.

18. The mobile computing device of claim 16, at least one of the first internal antenna and the second internal antenna comprising a first antenna arm including a first load and a second antenna arm including a second load.

19. A mobile computing device, comprising:

a housing enclosing a printed circuit board including a first internal antenna to allow WiFI communication and a second internal antenna to allow Bluetooth communication, at least one of the first internal antenna and the second internal antenna comprising a balanced antenna including a first antenna arm and a second antenna arm, the first antenna arm coupled to a 0 degree phase output port of the phase hybrid element, the second antenna arm coupled to a 180 degree phase output port of the phase hybrid element; and wherein the first internal antenna and the second internal antenna separated by a battery compartment.

20. The mobile computing device of claim 19, further comprising the battery compartment including one or more shield walls to reduce frequency coexistence interference.

21. The mobile computing device of claim 19, the first antenna arm including a first load and a second antenna arm including a second load.

* * * * *